United States Patent [19]

Harrington

[11] 4,359,784

[45] Nov. 23, 1982

[54] SLEEVE-MITTEN COMBINATION FOR GARMENT

[76] Inventor: Shirley L. Harrington, 51 E. Utica, Buffalo, N.Y. 14209

[21] Appl. No.: 207,685

[22] Filed: Nov. 17, 1980

[51] Int. Cl.[3] ..... A41D 27/10; A41D 19/00

[52] U.S. Cl. ..... 2/269; 2/158

[58] Field of Search ..... 2/269, 270, 169, 158, 2/159

[56] References Cited

U.S. PATENT DOCUMENTS

| | | | |
|---|---|---|---|
| 1,365,526 | 1/1921 | Milkes | 2/270 |
| 2,340,017 | 1/1944 | Rasmussen | 2/270 |
| 2,497,262 | 2/1950 | Jacobson | 2/270 |
| 2,675,554 | 4/1954 | Gertz | 2/270 |
| 2,697,837 | 12/1954 | Goldman | 2/270 |
| 3,214,771 | 11/1965 | Treiber | 2/270 |

*Primary Examiner*—Doris L. Troutman

*Attorney, Agent, or Firm*—Christel, Bean & Linihan

[57] ABSTRACT

A sleeve and mitten combination for jackets or similar outerwear, chiefly for children, comprises a sleeve formation terminating in a tubular mitten-formation which comprises an extension of the sleeve formation. A slide fastener extends across the outer end of the tubular mitten-formation and when the fastener is closed the wearer's hand is fully enclosed. When the fastener is opened, the mitten-formation may be turned back upon the sleeve formation to form a cuff and more or less fully expose the wearer's hand.

2 Claims, 4 Drawing Figures

SLEEVE-MITTEN COMBINATION FOR GARMENT

BACKGROUND OF THE INVENTION

This invention relates to sleeves for jackets or other outer garments, particularly for children. The construction is such that the outer ends of the sleeves may be closed as by means of a slide fastener to fully enclose the child's hands, or may be opened and turned back to form a cuff and free the child's hands.

The closest prior art known to applicant or her attorney, after a careful preliminary search, are the following U.S. Pats:

No. 2,318,785 Kopplin
No. 2,915,758 Kaufman
No. 2,675,554 Gertz
No. 2,621,336 Wendroff The above identified Kopplin patent shows a mitten as a separate article with a slide fastener disposed at the thumb side of the mitten and extending from a mid point at the bottom of the mitten to a point above the thumb formation. When this slide fastener is opened it permits the wearer to project his hand out of the side of the mitten for various manipulative purposes.

The above Kaufman patent shows a sleeve construction wherein mittens are removably attached to the sleeves of the garment by buttons so that the mitten may be completely removed from the garment or may remain in closed position over the end of the sleeve.

The above patent to Gertz covers a sleeve construction wherein a mitten is formed at the end of the sleeve and the outer end of the mitten is normally held closed by elastic means so that the hand of the wearer may, if desired, be projected through the end of the mitten to expose the wearer's hand by stretching of the elastic means and thus permit the mitten-formation to move upwardly above the hand of the wearer.

The above Wendroff patent shows a sleeping garment construction which normally encloses the hand of the child but wherein the hand portion of the sleeve may be rolled or folded back, not as a cuff, but merely to permit the child to hold a milk bottle or a plaything.

Other U.S. patents reported in the patentability search referred to above but not regarded as having any particular relevance to the present invention are as follows: Nos.

2,069,643 Burke
2,615,165 Steedman
2,291,861 Astrove
2,677,130 O'Hayer

SUMMARY OF THE INVENTION

In the construction of the present invention the slide fastener extends across the outer end of the sleeve construction so that such outer end may be fully opened when desired. In a preferred form this terminal portion of the sleeve of the garment is connected to the sleeve proper by a ribbed or knitted connection which facilitates folding the outer end of the sleeve portion, that is the mitten-forming portion, back over the sleeve proper and particularly the knitted cuff portion thereof when such is employed.

DESCRIPTION OF THE ILLUSTRATED EMBODIMENT

Figure 1:
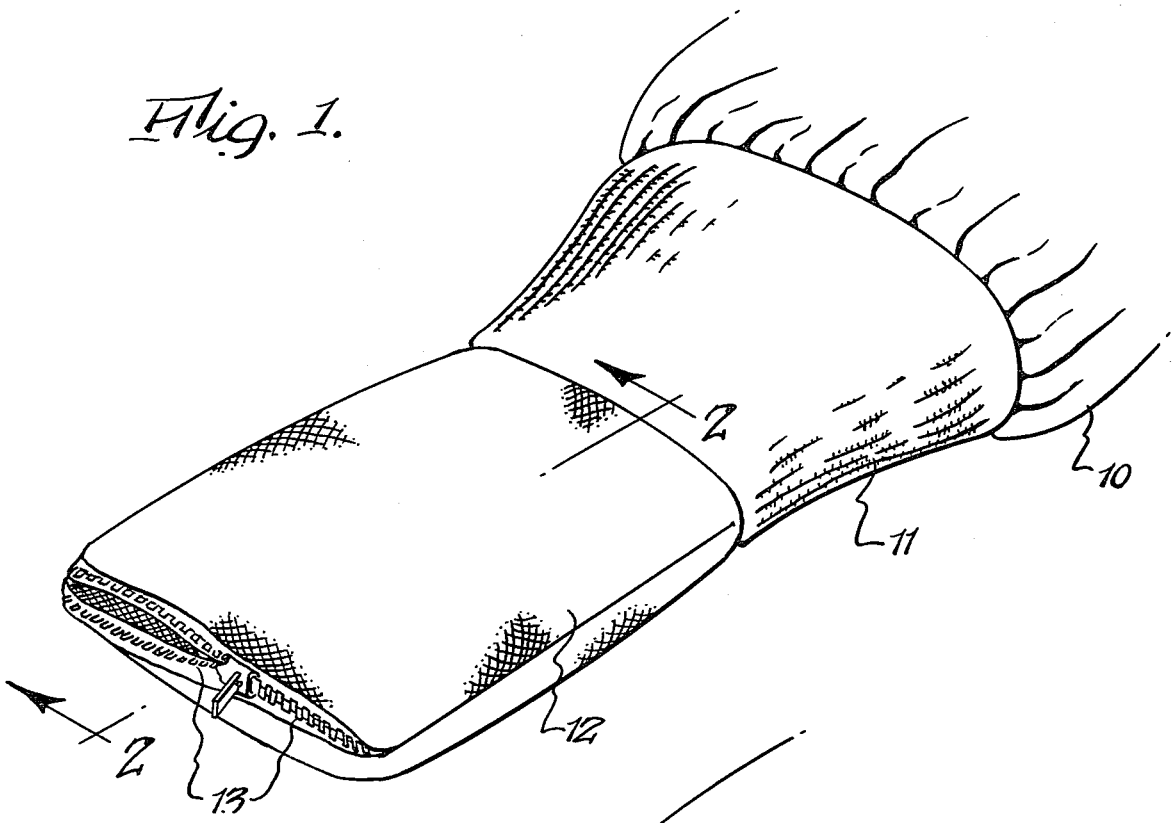
FIG. 1 is a perspective view of the outer end of the sleeve of a garment constructed in accordance with the present invention and with the hand-enclosing or mitten-forming portion of the sleeve extended.

FIG. 1 shows the outer end of a sleeve 10 which in the illustrated instance has a knitted or similar cuff portion 11 and a tubular extension 12 which normally encloses the hand of the child or other user. The outer end of the extension 12 is provided with a slide fastener closure 13 which in FIG. 1 is shown in a partially closed condition. When the slide fastener 13 is fully closed, the child's hand is fully enclosed and protected from the elements.

Figure 3:
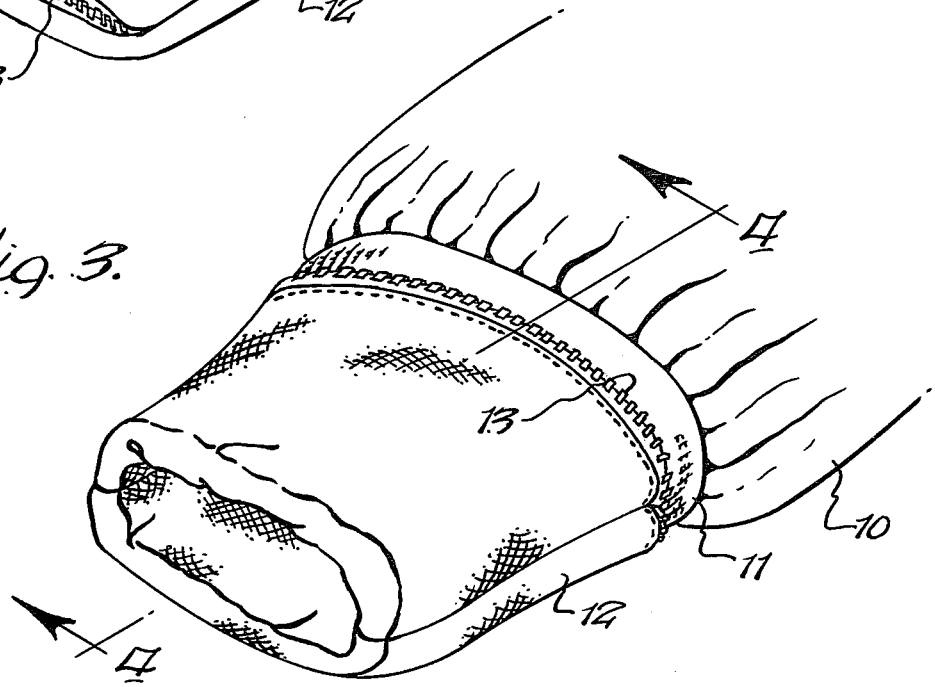
FIG. 3 is a view similar to FIG. 1 but with the mitten-forming portion thereof open and folded back to form or reinforce the cuff formation of the garment.
Figure 2:
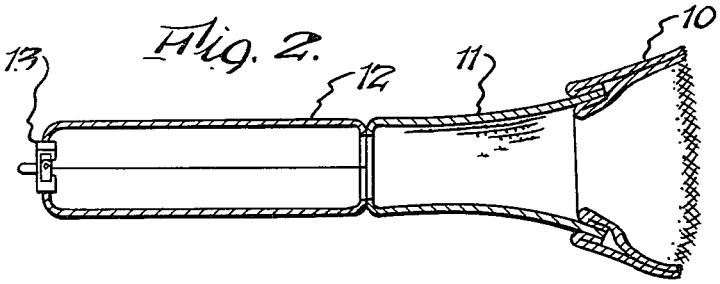
FIG. 2 is a cross-sectional view on the line 2—2 of FIG. 1.
Figure 4:
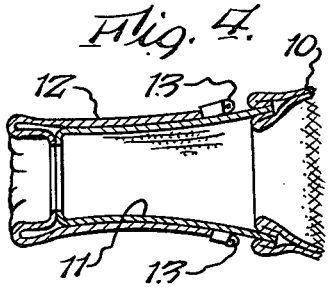
FIG. 4 is a cross-sectional view on the line 4—4 of FIG. 3.

When it is desired to free the wearer's hand from the mitten-formation 12 the slide fastener 13 is fully opened and the mitten 12 may then be turned back to overlie the cuff portion 11 as shown in FIG. 3 whereupon the wearer's hand is fully exposed.

If desired, the cuff portion 11 may be dispensed with and in such constructions the mitten-forming extension 12 will be turned back to overlie the end portion of the sleeve 10 itself.

A typical embodiment of the present invention has been described herein and shown in the accompanying drawing to illustrate the underlying principles of the invention, but it is to be understood that numerous modifications may be made without departing from the broad spirit and scope of the invention.

I claim:

1. A combined sleeve and mitten-formation for jackets or outerwear comprising a sleeve formation terminating in a tubular mitten-formation which extends outwardly from the end of the sleeve formation, the tubular mitten-formation defining a tubular member having a unitary opening spaced from the sleeve formation and disposed transversely of the longitudinal axis thereof, and a slide fastener extending across the unitary opening of the tubular mitten-formation which when closed fully encloses the wearer's hand and when opened permits the mitten formation to be turned back upon the sleeve formation to form a cuff and more or less fully expose the wearer's hand.

2. A sleeve and mitten-formation according to claim 1 wherein a laterally elastic cuff portion connects between the outer end of the sleeve proper and the adjacent end of the mitten-formation whereby the mitten-formation may be folded back upon said cuff portion.

* * * * *